US008141595B2

(12) United States Patent
Quigley

(10) Patent No.: US 8,141,595 B2
(45) Date of Patent: Mar. 27, 2012

(54) WEAR SIDE WEAVE PATTERN OF A COMPOSITE FORMING FABRIC

(75) Inventor: Scott Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 404 days.

(21) Appl. No.: 12/541,234

(22) Filed: Aug. 14, 2009

(65) Prior Publication Data

US 2010/0032119 A1 Feb. 11, 2010

Related U.S. Application Data

(63) Continuation of application No. PCT/EP2008/001174, filed on Feb. 15, 2008.

(51) Int. Cl.
*D03D 11/00* (2006.01)
*D21F 1/00* (2006.01)

(52) U.S. Cl. ..... 139/383 A; 139/383 R; 139/383 AA; 162/358.2

(58) Field of Classification Search ..... 139/383 R, 139/383 A, 383 AA, 408, 411, 412, 413, 139/414; 162/348, 358.1, 358.2, 900, 902, 162/903, 904
See application file for complete search history.

(56) References Cited

U.S. PATENT DOCUMENTS 5,152,326 A 10/1992 Vohringer
5,219,004 A * 6/1993 Chiu ..... 139/383 A
5,544,678 A 8/1996 Barrett
6,896,009 B2 * 5/2005 Ward ..... 139/383 A
7,007,722 B2 3/2006 Quigley et al.
7,048,012 B2 * 5/2006 Martin et al. ..... 139/383 A
7,059,359 B2 * 6/2006 Quigley et al. ..... 139/383 A
7,124,781 B2 10/2006 Fahrer et al.
7,249,615 B2 * 7/2007 Westerkamp et al. .... 139/383 A
7,426,943 B2 9/2008 Ueda et al.
(Continued)

FOREIGN PATENT DOCUMENTS

EP 0 794 283 A1 10/1997
(Continued)

OTHER PUBLICATIONS

Documents in PCT/EP2008/001174, dated Aug. 6, 2008 (Notification of Transmittal, International Search Report, Written Opinion of International Searching Authority).
(Continued)

*Primary Examiner* — Bobby Muromoto, Jr.
(74) *Attorney, Agent, or Firm* — Taylor IP, P.C.

(57) ABSTRACT

A fabric for papermaking includes a first layer side, a second layer side and at least one binder warp yarn pair. The first side layer has a plurality of first weft yarns and a plurality of first warp yarns. The second side layer has a plurality of second weft yarns and a plurality of second warp yarns. The at least one binder warp yarn pair includes a first binder warp yarn pair having a first binder warp yarn and a second binder warp yarn, the first side layer and the second side layer being bound by the first binder warp yarn pair. The first binder warp yarn and the second binder warp yarn exchange the layer to which they are woven at exchange points. A knuckle is formed with the first binder warp yarn and an adjacent first warp yarn, a subsequent adjacent knuckle only being formed with the first binder warp yarn and an opposite adjacent first warp yarn.

17 Claims, 13 Drawing Sheets

U.S. PATENT DOCUMENTS

| | | | | |
|---|---|---|---|---|
| 7,503,351 | B2 * | 3/2009 | Hack-Ueberall | 139/383 R |
| 7,534,325 | B2 * | 5/2009 | Quigley et al. | 162/348 |
| 7,604,025 | B2 * | 10/2009 | Quigley | 139/383 A |
| 7,743,795 | B2 * | 6/2010 | Quigley | 139/383 A |
| 2004/0079434 | A1 * | 4/2004 | Martin et al. | 139/383 A |
| 2004/0149342 | A1 * | 8/2004 | Troughton | 139/383 R |
| 2004/0149343 | A1 * | 8/2004 | Troughton et al. | 139/383 R |
| 2004/0182464 | A1 * | 9/2004 | Ward | 139/383 A |
| 2004/0182465 | A1 * | 9/2004 | Ward | 139/383 A |
| 2004/0238063 | A1 * | 12/2004 | Stone | 139/383 A |
| 2005/0121097 | A1 * | 6/2005 | Ward | 139/383 A |
| 2005/0139281 | A1 * | 6/2005 | Martin et al. | 139/383 A |
| 2005/0268981 | A1 * | 12/2005 | Barratte | 139/383 A |
| 2006/0016509 | A1 * | 1/2006 | Westerkamp et al. | 139/383 R |
| 2006/0102244 | A1 * | 5/2006 | Ueda et al. | 139/383 A |
| 2006/0219312 | A1 * | 10/2006 | Hay et al. | 139/383 A |
| 2006/0260708 | A1 * | 11/2006 | Ueda et al. | 139/383 A |
| 2006/0278295 | A1 * | 12/2006 | Ueda et al. | 139/383 A |
| 2007/0028996 | A1 * | 2/2007 | Quigley | 139/383 R |
| 2007/0095416 | A1 * | 5/2007 | Ueda | 139/383 A |
| 2007/0095417 | A1 * | 5/2007 | Fujisawa | 139/383 A |
| 2007/0157987 | A1 | 7/2007 | Ward | |
| 2008/0035230 | A1 * | 2/2008 | Danby et al. | 139/383 A |
| 2008/0149213 | A1 * | 6/2008 | Quigley | 139/408 |
| 2008/0149214 | A1 * | 6/2008 | Quigley | 139/410 |
| 2008/0169040 | A1 * | 7/2008 | Barrett | 139/383 A |
| 2008/0196784 | A1 * | 8/2008 | Quigley | 139/383 A |
| 2010/0032119 | A1 * | 2/2010 | Quigley | 162/358.2 |

FOREIGN PATENT DOCUMENTS

| | | | |
|---|---|---|---|
| WO | 2004085740 | A2 | 10/2004 |

OTHER PUBLICATIONS

Document in PCT/EP2008/001174, dated Aug. 12, 2008 (Notification of Decision Concerning Request for Rectification).

Document in PCT/EP2008/001174, dated Sep. 5, 2008 (Communication regarding rectified sheets).

* cited by examiner

WEAR SIDE WEAVE PATTERN OF A COMPOSITE FORMING FABRIC

CROSS REFERENCE TO RELATED APPLICATIONS

This is a continuation of PCT application No. PCT/EP2008/001174, entitled "WEAR SIDE WEAVE PATTERN OF A COMPOSITE FORMING FABRIC", filed Feb. 15, 2008, which is incorporated herein by reference.

BACKGROUND OF THE INVENTION

1. Field of the Invention

The present invention relates to compound papermaking fabrics. More specifically, the present invention relates to forming fabrics used in the forming section of a papermaking machine.

2. Description of the Related Art

In the art of papermaking, multiple steps occur from the introduction of a pulp slurry to the output of a finished paper product. The initial introduction of the slurry is at the portion of a papermaking machine known as the wet end. Here, the slurry, or fiber suspension, is initially dewatered when the slurry is introduced onto a moving forming fabric, in the forming section of the papermaking machine. Varying amounts of water is removed from the slurry through the forming fabric, resulting in the formation of a fibrous web on the surface of the forming fabric.

Forming fabrics address not only the dewatering of the slurry, but also the sheet formation, and therefore the sheet quality, resulting from the formation of the fibrous web. More specifically, the forming fabric must simultaneously control the rate of drainage while preventing fiber and other solid components contained in the slurry from passing through the fabric with the water. The role of the forming fabric also includes conveyance of the fibrous web to the press section of the papermaking machine.

Additionally, if the drainage occurs too rapidly or too slowly, the quality of the fibrous web is reduced, and overall machine production efficiency is reduced. Controlling drainage by way of fabric void volume is one of the fabric design criteria.

Forming fabrics have been produced to meet the needs and requirements of the various papermaking machines for the various paper grades being manufactured. As the need arises to increase production speed of the papermaking machines and the quality of the paper being produced, the need for improved paper machine clothing allowing for increase production rates and improved quality has resulted.

A twill pattern in woven fabrics is where a fabric is woven with a pattern of diagonal ribs. The twill is typically made by passing the weft threads over one warp thread and then under two or more warp threads. In this manner, in a twill weave, each warp or filling yarn floats across two or more filling or warp yarns with a progression of interlacings by one to the right or left, which forms a distinct diagonal line, or wale. A float is defined as the portion of yarn that crosses over two or more yarns from the opposite direction.

Twill weaves are generally designated as a fraction or ratio, for example 2:1, where the numerator indicates the number of harnesses that are raised, and the denominator indicates the number of harnesses that are lowered.

A straight twill used in forming fabrics is well known, for example, in FIG. 1 a fabric 10 has a straight twill pattern 14. This fabric is prone to guide poorly and can lead to curling of the fabric edges. The twill pattern 14 can also "strike through," or cause marking, and can cause drainage, or hydraulic marks on the web being formed on the fabric. Additionally, twill patterns also have the possibility of creating holes on the back of the fabric that are too large, resulting in drainage marks.

U.S. Pat. No. 5,152,326 (Vohringer '326) discloses a composite forming fabric having pairs of fabric borne warp binder yarns. However, Vohringer '326 does not prevent diagonal marking of the web caused by the diagonals present in the weave pattern, and unbroken diagonals are not addressed.

U.S. Pat. No. 5,544,678 (Barrett '678) discloses different float lengths achieved by using additional or intrinsic binders.

WO 2004/085740 to Ward discloses the use of varying the warp or weft ratios between the top and bottom layers in order to break up the twill pattern. This break up of the twill pattern occurs only on the paper side surface of the fabric.

SUMMARY OF THE INVENTION

Accordingly, the present invention is for a fabric used in papermaking, and more particularly, as a forming fabric. In the preferred embodiment, the fabric is a composite multilayer forming fabric whereby the diagonal twill is broken up on the wear side of the fabric. Also in a preferred embodiment, the warp paths are moved left and right alternatively, disturbing the twill-type pattern.

One method of breaking up the twill line is to overlap adjacent warp pairs. By offsetting an adjacent warp pair, a gap in the diagonal is created.

Another method of breaking up the twill line involves the use of four different floats on each warp yarn of three separate lengths. Fabric born binders are used. In contrast, Barrett '678 discloses at least two lengths of float and additional or intrinsic binder.

In the first methods of breaking up the twill line, the warp pairs stay together.

In another embodiment of the present invention, all of the warp yarn pairs change pairing to the left and to the right. There can also be a 2:1 weft ratio or a 1:1 weft ratio.

For example, a fabric for papermaking can have a first side layer, the first side layer having a plurality of first weft yarns and a plurality of first warp yarns; a second side layer, the second side layer having a plurality of second weft yarns and a plurality of second warp yarns; at least one binder warp yarn pair; wherein the first side layer and the second side layer are bound by the binder warp yarn pair; wherein the binder warp yarn pair is an exchange warp pair that exchanges at exchange points; wherein the binder warp yarn pair is woven in binder warp pair yarn groups in a repeating pattern; and wherein each repeating pattern of the binder warp yarn group forms a broken twill pattern.

Still further, the fabric has a first binder warp yarn pair having a first warp yarn and a second warp yarn; wherein between a first exchange point and a second exchange point of the first warp binder yarn pair, the first warp yarn forms a knuckle on the first side layer, the first side layer knuckle of the first warp yarn being adjacent to one of the second warp yarn and an adjacent first side layer first warp yarn. In this manner, one of the binder pair's yarns is moving from its own pair to the warp yarn on the left or right side of it, in an alternating fashion. This breaks up the twill pattern, and gives the appearance that one of the warp pair yarns is floating from left to right.

It is also understood that there are no limitations to the paper grades or former types where this invention can be applied. It is also understood that the fabric can be woven utilizing either two or three warp beams.

These and other features and advantages of this invention are described in or are apparent from the following detailed description of the preferred embodiments.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
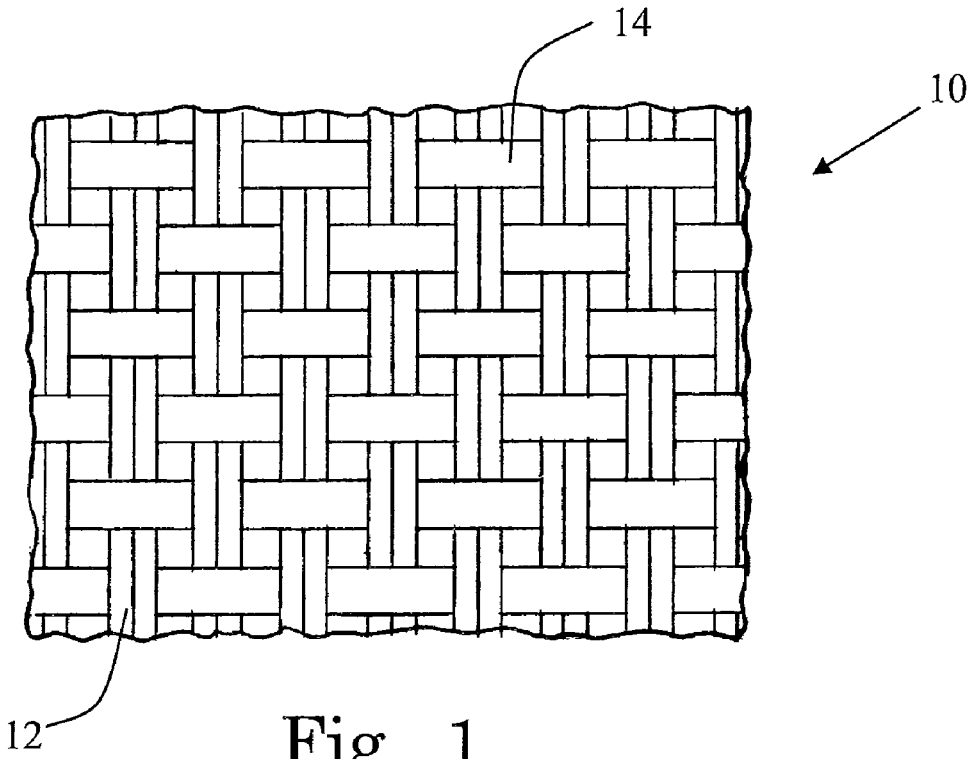
FIG. 1 is a plan view of the prior art.

FIGS. 1, 2 and 3A-3C show the prior art. In FIG. 1, a plan view of the wear side of a papermaking forming fabric 10 having paired bottom warps 12, and shows a diagonal twill 14.

Figure 2:
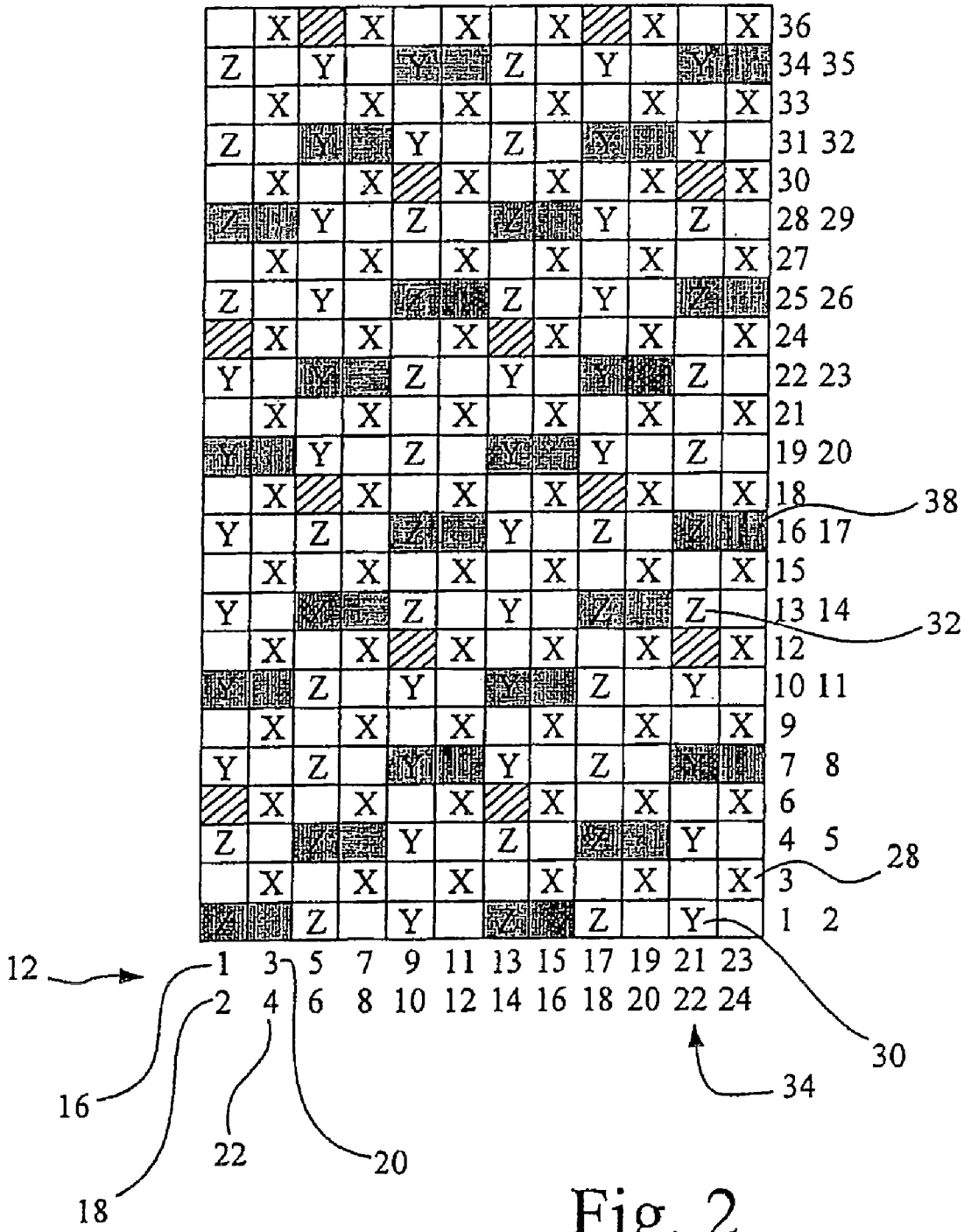
Fig. 2 PRIOR ART
FIG. 2 is a weave pattern of a prior art fabric having paired bottom warps.
Figure 3A:
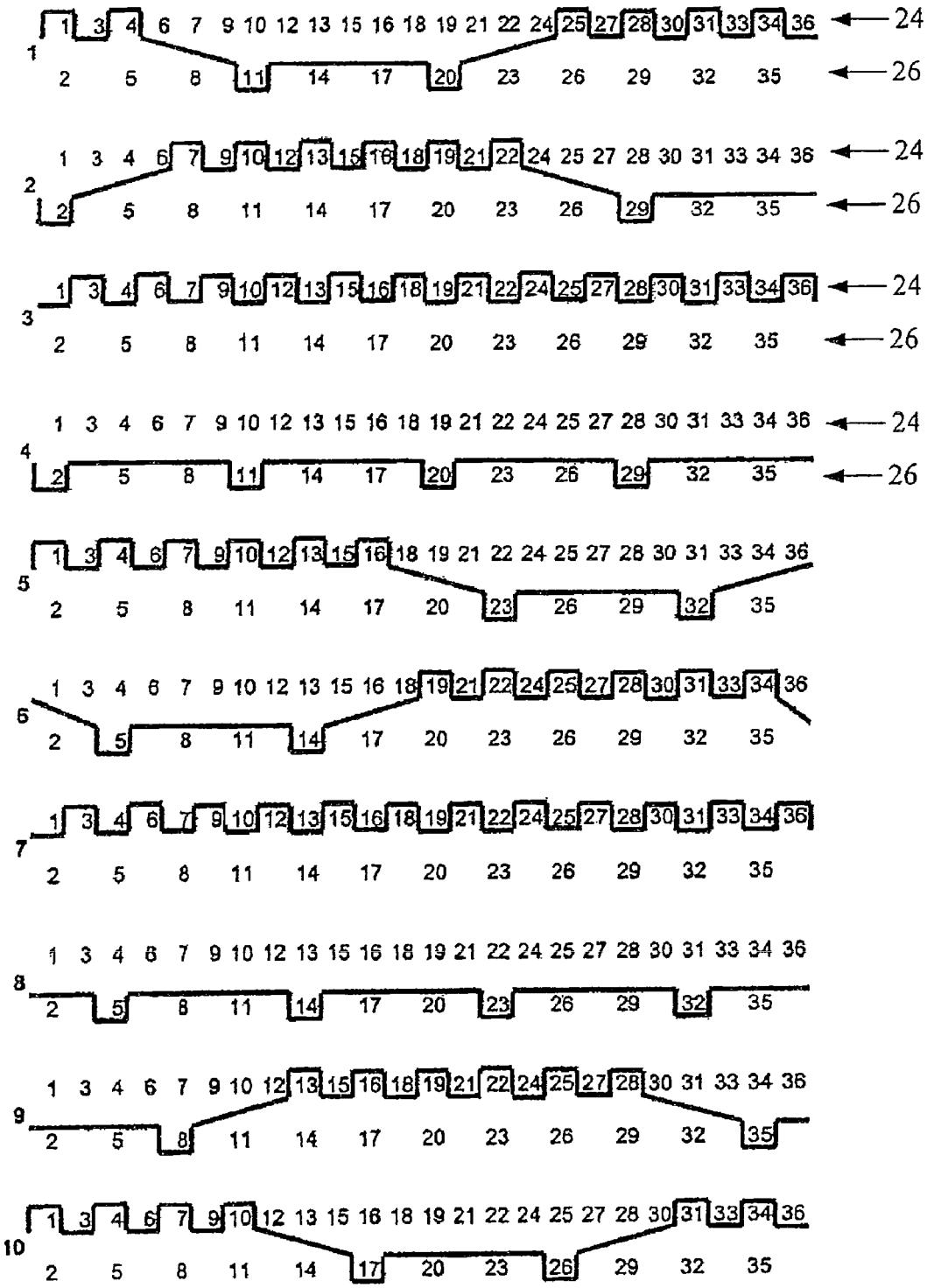
FIGS. 3A-3C show the individual weave pattern for each warp yarn of FIG. 2.
Figure 3B:
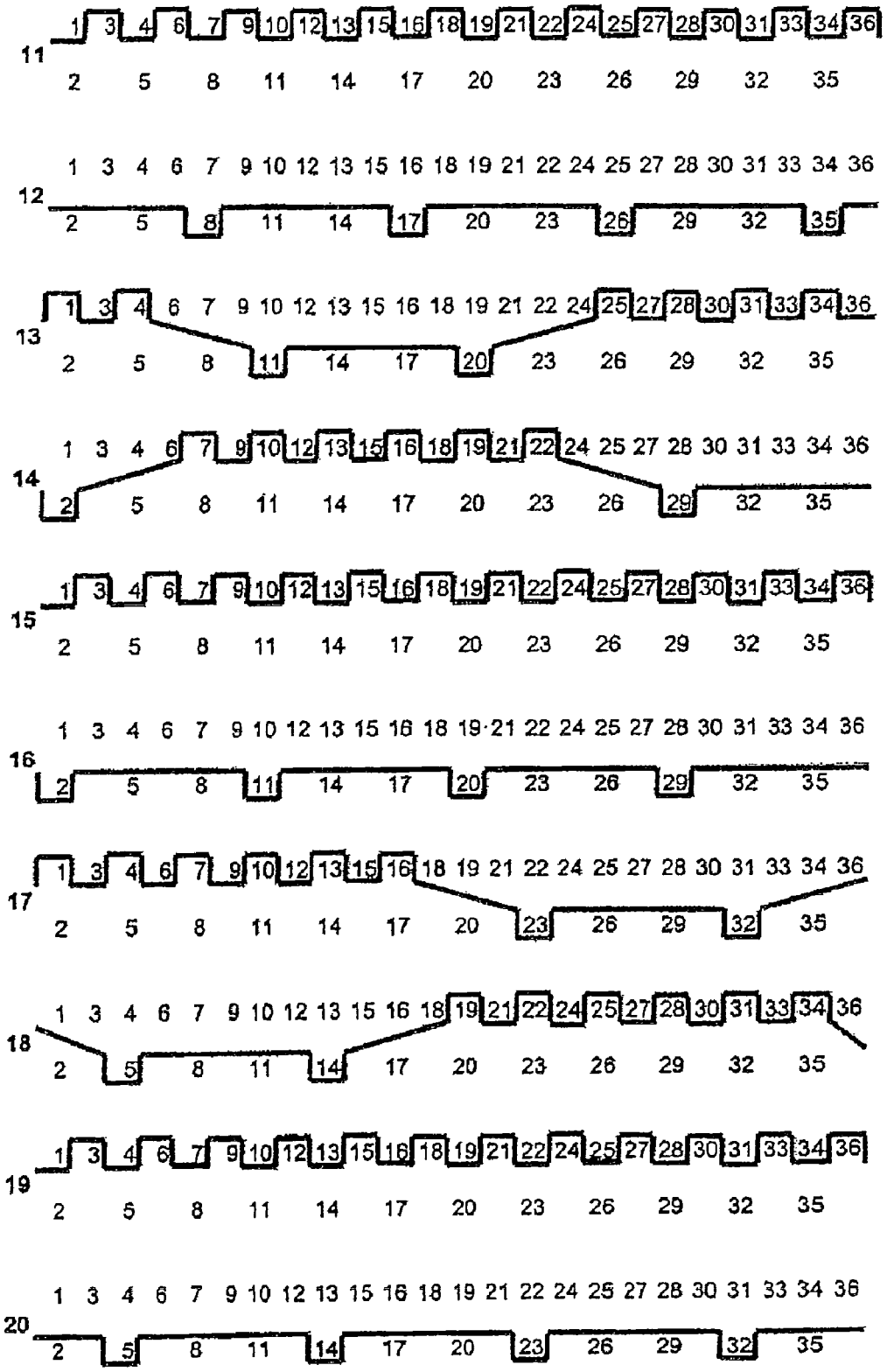
Figure 3C:
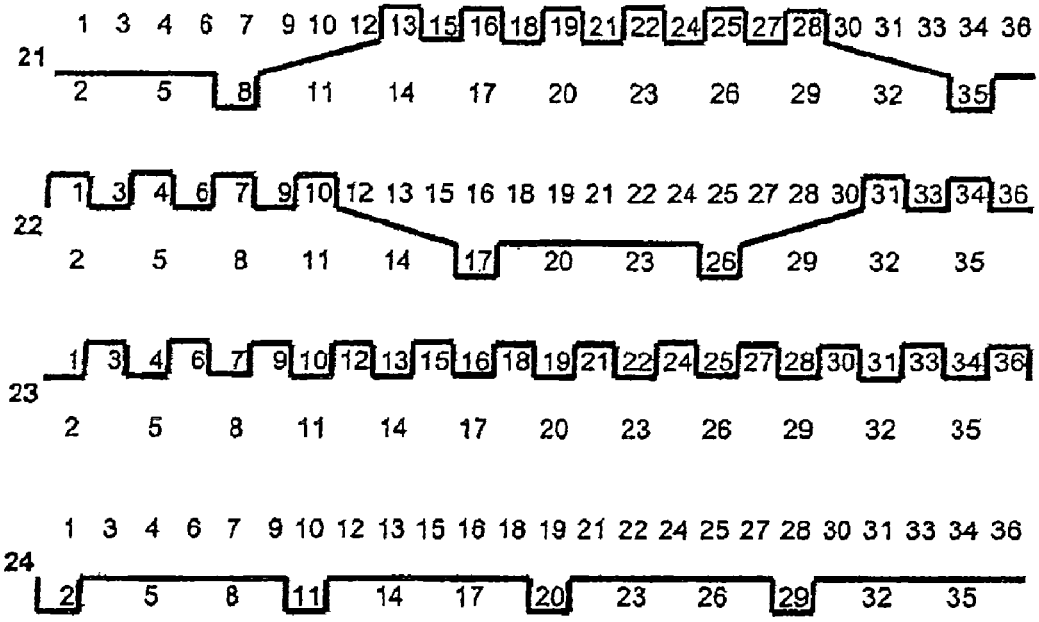

In FIG. 2, the weave pattern for fabric 10 of the prior art having paired bottom warps 12 is shown. FIGS. 3A-3C show the individual weave patterns for each warp yarn of FIG. 2. Alternate columns of FIG. 2 represent warp yarns that are binder warp yarn pairs 12. For example, warp yarns marked 16 and 18 are a binder warp yarn pair 12. Warp yarns 20 and 22 are only associated with either a top fabric 24 or a bottom fabric 26. Warps marked with an X 28 indicate that a top knuckle is formed. Boxes marked with a Y 30 and Z 32 are binder warp yarn pairs 34. The cross-hatched boxes 36 indicate where a warp exchange occurs between the binder yarns 30 and 32 of binder warp yarn pair 34. The gray boxes 38 are where bottom knuckles occur. In a warp pair group 34, when a binder warp yarn Y 30 occurs in a white box, the binder warp yarn Y 30 is forming a top knuckle. When a binder warp yarn Y 30 is in a gray box 38, the corresponding binder warp yarn Z 32 is forming a bottom knuckle.

The same is true of a warp pair group 34, when a binder warp yarn Z 32 occurs in a white box, the binder warp yarn Z 32 is forming a top knuckle. When a binder warp yarn Z 32 is in a gray box 38, the corresponding binder warp yarn Y 30 is forming a bottom knuckle.

Figure 6:
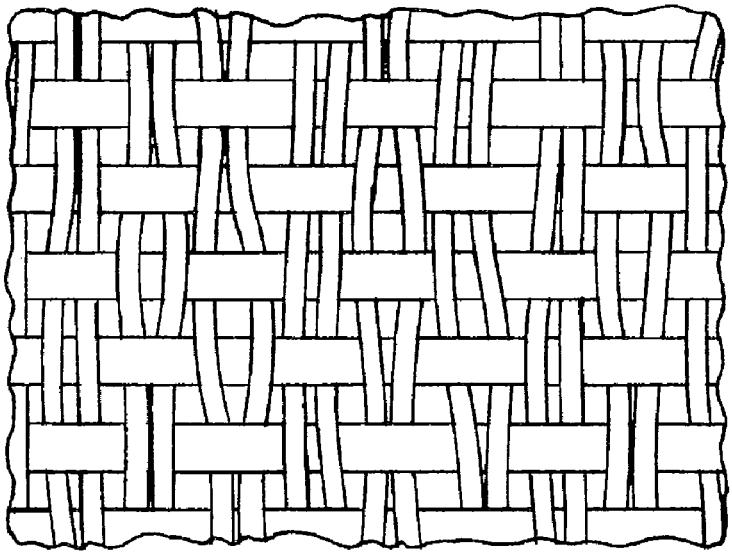
FIG. 6 shows a plan view of the fabric of FIG. 4.
Figure 4:
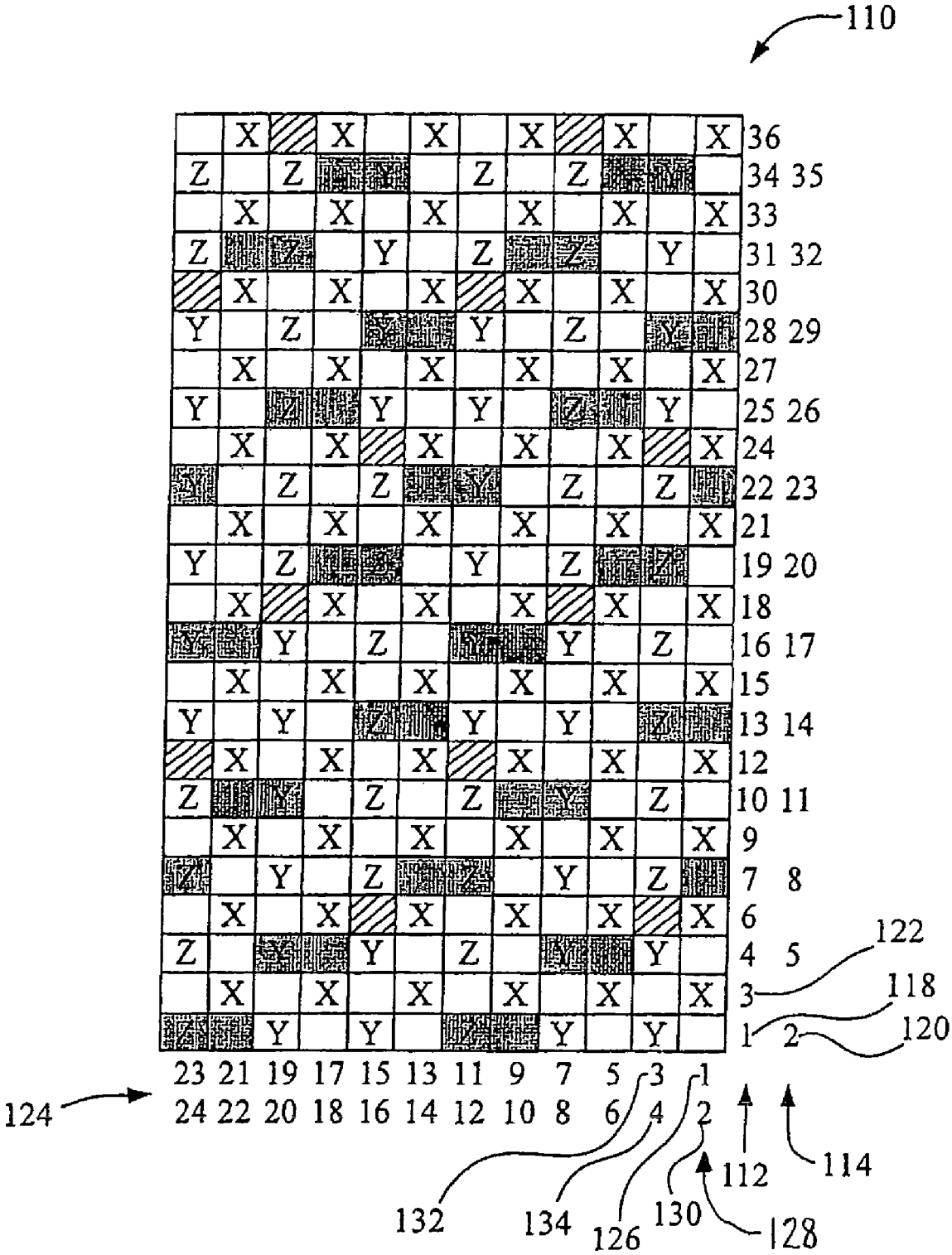
FIG. 4 shows a weave pattern for a fabric having a 2:1 weft ratio arrangement according to an embodiment of the present invention.
Figure 5A:
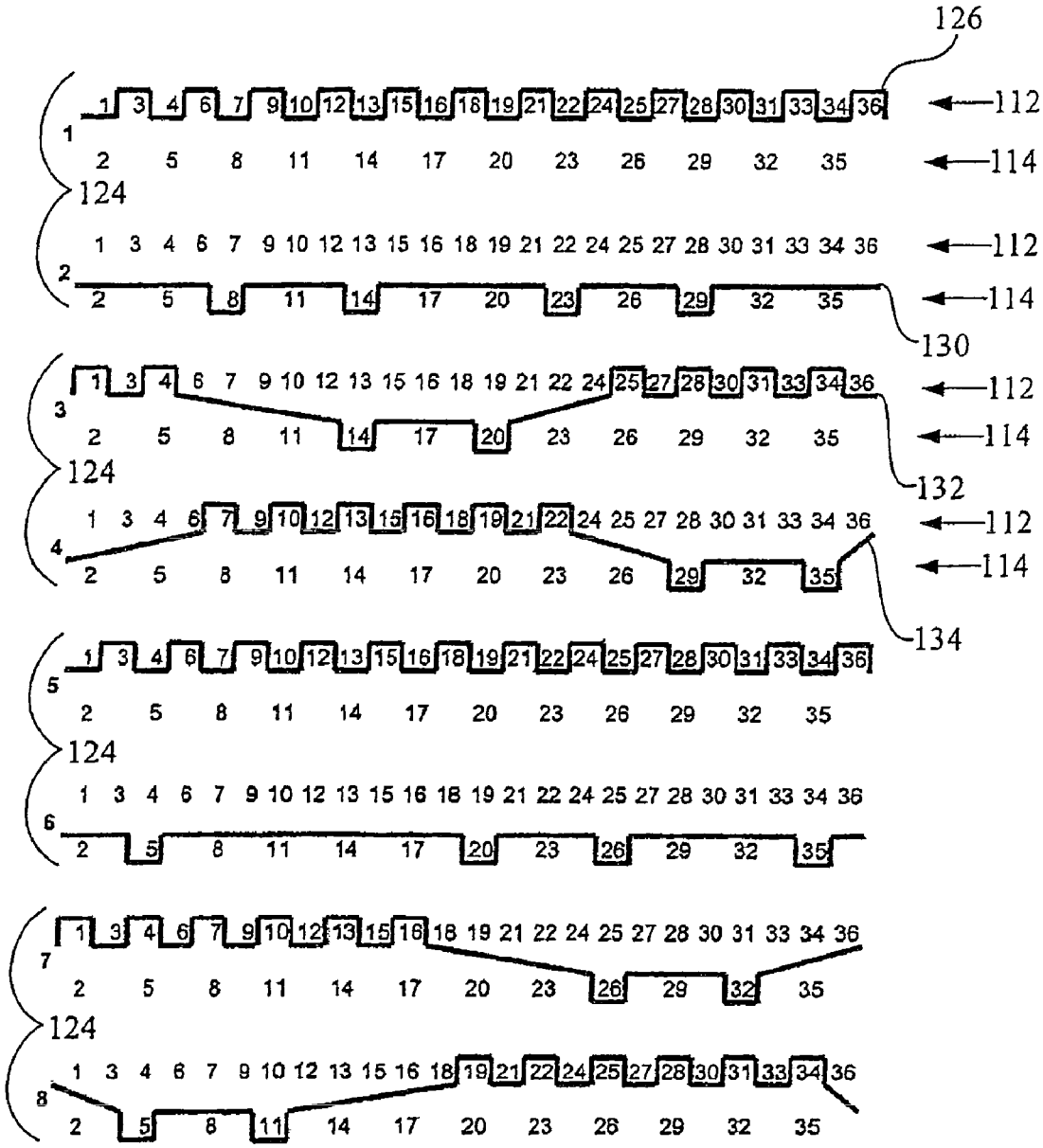
FIGS. 5A-5C show the individual weave pattern for each warp yarn of FIG. 4.
Figure 5B:
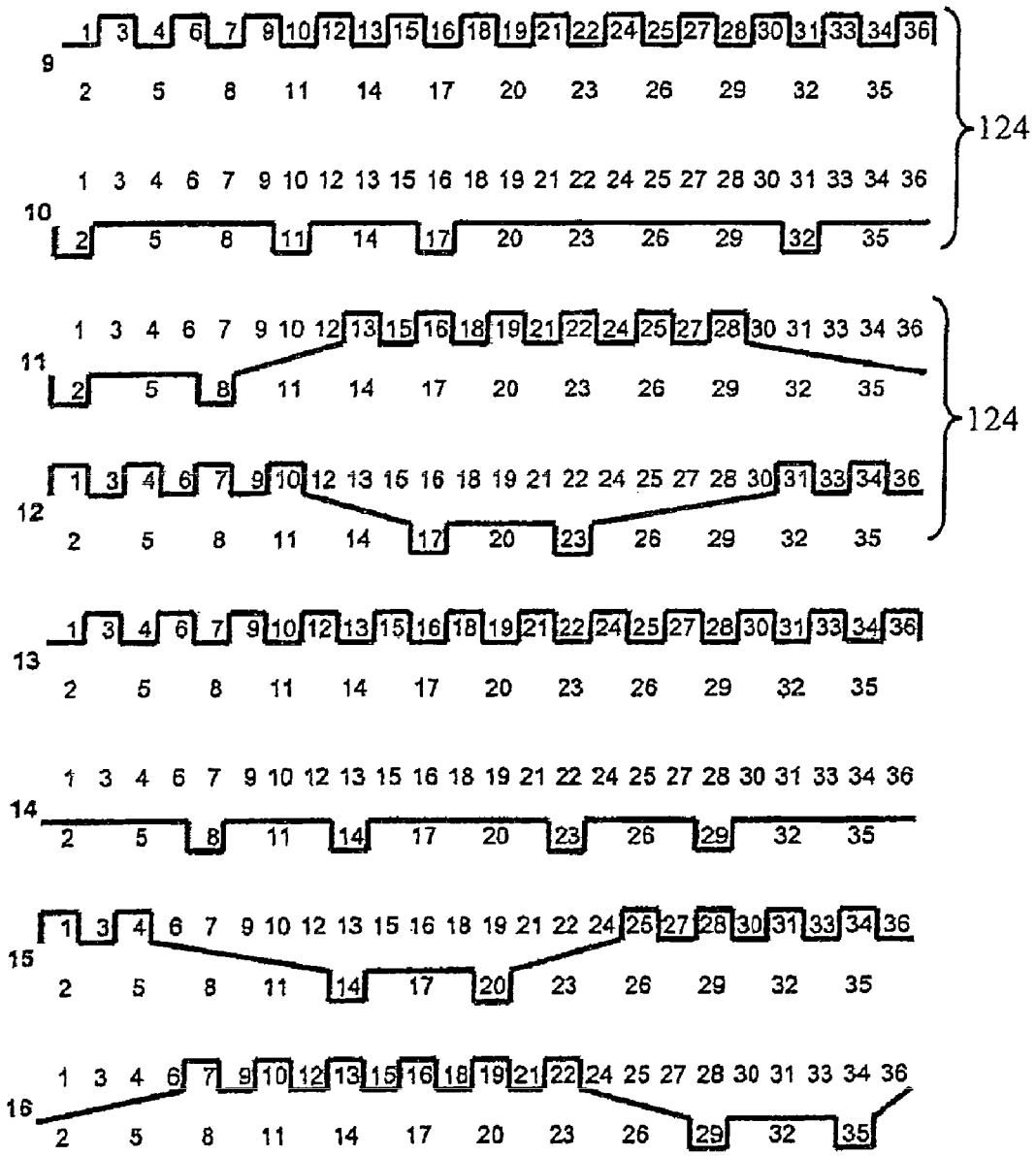
Figure 5C:
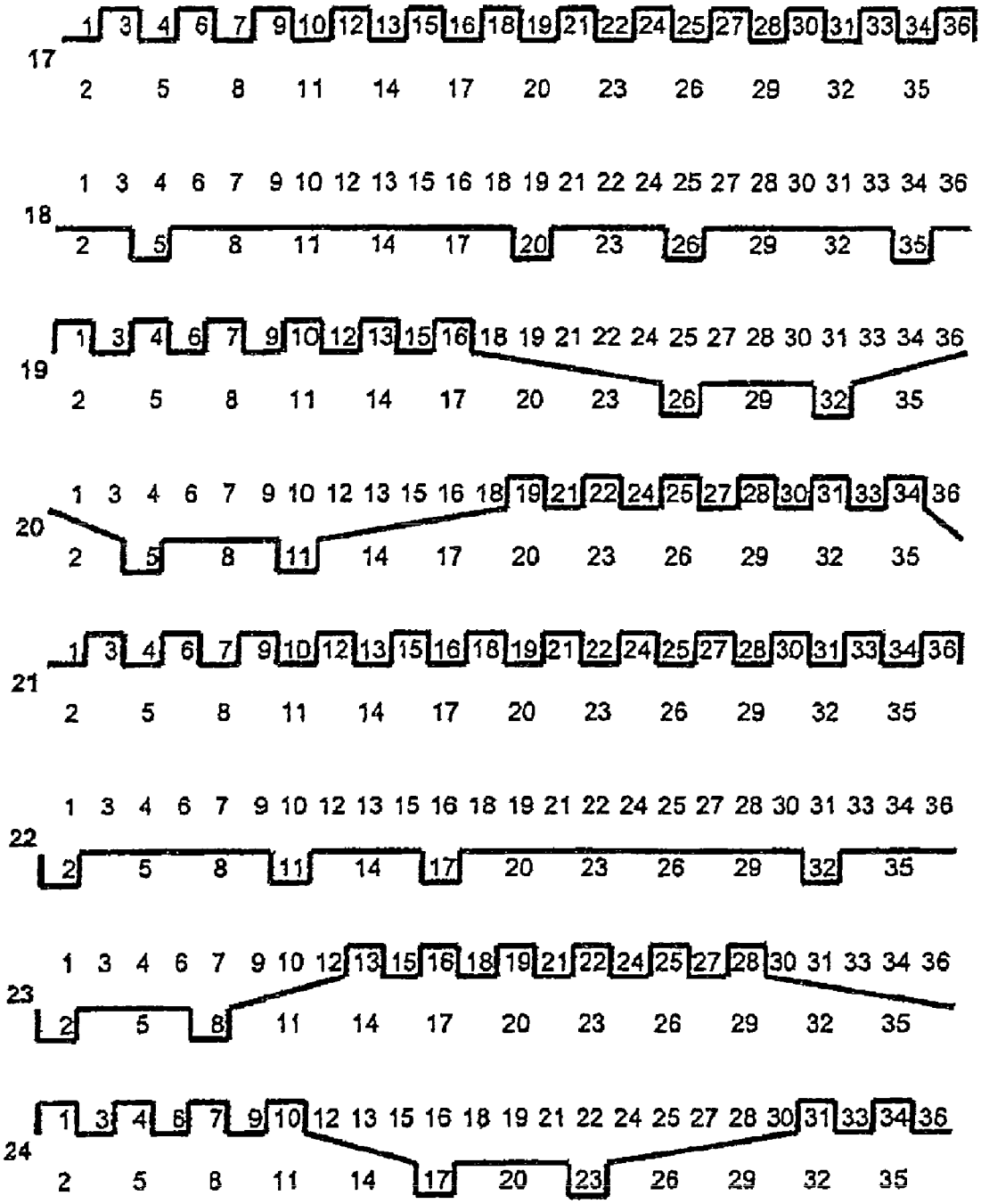

FIG. 4 shows a weave pattern for a fabric 110 having a 2:1 weft ratio arrangement according to the present invention. FIGS. 5A-5C show the individual weave pattern for each warp yarn of FIG. 4; and FIG. 6 shows a plan view of the fabric of FIG. 4, with a broken twill pattern.

FIGS. 5A-5C depicts a cross-sectional view of a triple layer fabric 110 having a 2:1 weft ratio according to the present invention, fabricated on a two beam loom. FIG. 4 depicts the forming side plan view of the same fabric 110.

A first weft system 114 is shown below a second weft system 112. Each weft system 112 and 114 is made up of a plurality of yarns 118, 120. First weft yarn 120 has a first yarn diameter, second weft yarn 118 has a second yarn diameter. The first and second yarn diameters 118, 120 can be the same or different.

First weft system 114 and second weft systems 112 are bound together by a plurality of warp systems 124. FIGS. 5A-5C shows six warp systems 124 in a repeating pattern. Each warp system 124 has at least one warp yarn (illustrated in the example as having 2 warp yarns per warp system, such as yarns 1 and 2), and each warp yarn system is woven as shown in FIGS. 5A-5C.

The weft and warp yarn materials include, but are not limited to, monofilament yarns, synthetic or polyester monofilament yarns, twisted monofilament yarns, twisted synthetic or twisted polyester or twisted polyamide monofilament yarns, twisted multi-filament yarns, twisted synthetic or twisted polyester multi-filament yarns, and others. Various yarn profiles can be employed, including but not limited to, yarns having a circular cross sectional shape with one or more diameters, or other cross sectional shapes, for example, non-round cross sectional shapes such as oval, or polygonal cross sectional shapes, for example diamond, square, pentagonal, hexagonal, septagonal, octagonal, and so forth, or any other shape that the yarns may be fabricated into.

First warp yarn 130 weaves the bottom or first weft system 114. Second warp yarn 126 weaves second or top weft system 112. Warp yarns 132 and 134 form what is called exchange warp binder yarns. An exchange warp is, for example, when one member of a pair of warp yarns 132 and 134 is weaving with first weft system 114, and the other member of the pair of warp yarns 132 and 134 is weaving with second weft system 112 and vice versa. Stated differently, an exchange warp allows for one binder warp yarn of a pair of binder warp yarns to weave in alternate fashion such that when the first binder warp yarn 132 is weaving with first weft system 114, the second binder warp yarn 134 of the pair is not weaving with first weft system 114 but is weaving with the second weft system 112, and while the second binder warp yarn of the pair is weaving with the first weft system 114, the first binder warp yarn of the pair is weaving with the second weft system.

This means that both the warp yarn 132 and warp yarn 134 are not weaving with the same weft system at the same time.

In the present invention, while depicting a plurality of warp systems 124, some yarns of the warp systems form exchange warp pairs and some of the warp systems do not form exchange warp pairs. For example, the warp yarn 126 and warp yarn 130 form the first warp system 128, which is not an exchange warp pair. In contrast, warp yarn 132 and warp yarn 134 do form an exchange warp pair. Accordingly, when warp yarn 132 crosses warp yarn 134 an exchange warp is formed.

FIG. 4 depicts the forming side plan view of the triple layer fabric 110 having a 2:1 weft ratio of the present invention. In this example, it can be readily seen that warp yarns 132 and 134 form a warp system, and therefore a warp pair that forms an exchange warp. The warp yarn systems are independent from one another and each have a mesh density that is independent. In FIG. 4 the 'X' notation marks where a knuckle is formed by a second warp yarn that is woven exclusively with a second weft yarn of the paper side. The 'Y' indicates where a knuckle is formed by a first binder warp yarn of a binder warp yarn pair that is woven with second weft yarns of the paper side of the fabric. The 'Z' indicates where a knuckle is formed on the paper side of the fabric by the second binder warp yarn of the binder pair weaving with second weft yarns. The shaded boxes indicate where a knuckle is formed by a first warp yarn or a binder warp yarn weaving with only one first weft yarn on the wear side of the fabric 110.

As can be seen each binder warp yarn pair 3,4; 7,8; 11,12; 15,16; . . . is located between subsequent adjacent first warp yarns. E.g. binder warp yarn pair 3,4 is located between subsequent adjacent warp yarns 2 and 6.

When weaving the first layer weft yarns each first binder warp yarn of the pairs weave in the following manner between subsequent adjacent exchange points:

the first binder warp yarn 3, 7, 11, 15, . . . and the right of the two subsequent adjacent first warp yarns 2, 6, 10, . . . form a first knuckle with a same first weft yarn; and the first binder warp yarn 3, 7, 11, 15, . . . and the left of the two subsequent adjacent first warp yarns 2, 6, 10, . . . form a subsequent adjacent second knuckle with a same other first weft yarn.

By way of example first binder warp yarn 3 of binder pair 3,4 forms a first knuckle with first weft yarn 14. Further first warp yarn 2 (which is the first of the two subsequent adjacent first weft yarns), being located on the right side of binder pair 3,4, is forming a first knuckle with the same first weft yarn 14. Further on, first binder warp 3 forms a second knuckle with first weft yarn 20 and first warp yarn 6 (which is the second of the two subsequent adjacent first weft yarns), being located on the left side of binder pair 3,4, is forming a second knuckle with the same first weft yarn 20.

When weaving the first layer weft yarns each second binder warp yarn of the pairs weave in the following manner between subsequent adjacent exchange points:

the second binder warp yarn 4, 8, 12, 16, . . . and the right of the two subsequent adjacent first warp yarns 2, 6, 10, . . . form a third knuckle with a same first weft yarn; and the second binder warp yarn 4, 8, 12, 16, . . . and the left of the two subsequent adjacent first warp yarns 2, 6, 10, . . . form a subsequent adjacent fourth knuckle with a same other first weft yarn.

By way of example second binder warp yarn 4 of binder pair 3,4, forms a third knuckle with first weft yarn 29. Further first warp yarn 2 (which is the first of the two subsequent adjacent first weft yarns), being located on the right side of binder pair 3,4, is forming a third knuckle with the same first weft yarn 29. Further on, second binder warp 4 forms a fourth knuckle with first weft yarn 35 and first warp yarn 6 (which is the second of the two subsequent adjacent first weft yarns), being located on the left side of binder pair 3,4, is forming a fourth knuckle with the same first weft yarn 35.

The cross-slashed boxes indicate where warp yarns exchange the layer of weft yarns each warp yarn is individually woven with. Since the invention is directed to triple layer fabric, the side shown is the paper side with the wear side being on opposite side as indicated in FIG. 4.

The warp yarns can have different diameters, for example warp yarns 126, 130, 132 and 134 can each have a different diameter. The warp yarns and the weft yarns can include monofilament yarns and twisted pair yarns.

This pattern repeats throughout the forming side plan view. Accordingly, the views in FIGS. 4 and 5A-5C show a pattern. That is repeated every 36 weft yarns in the machine direction and every 12 warp yarns in the cross-machine direction, resulting in a broken twill pattern.

Figure 7:
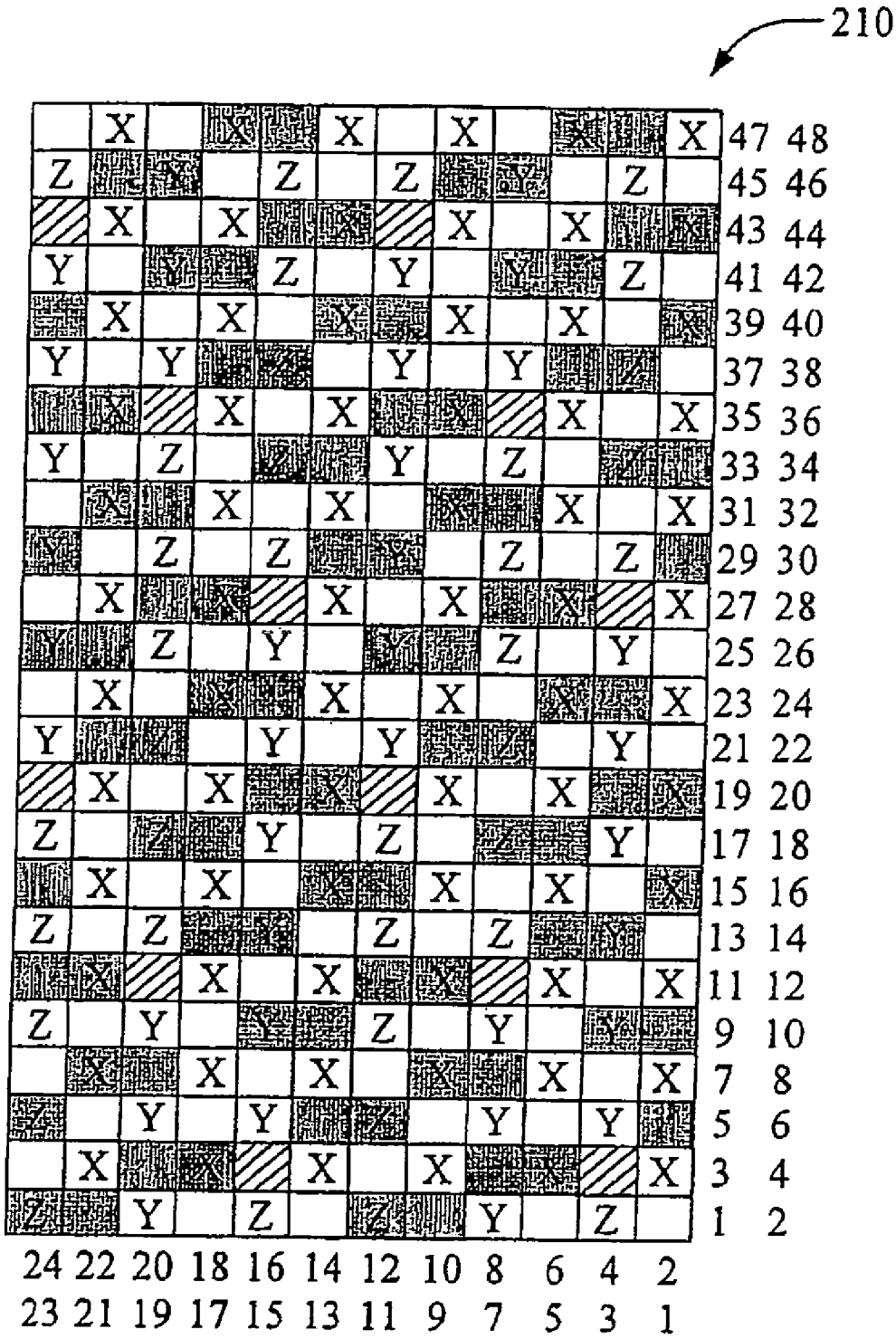
FIG. 7 shows a weave pattern for a fabric having a 1:1 weft ratio arrangement according to another embodiment of the present invention.

FIGS. 7 and 8A-C depict a cross-sectional view of a triple layer fabric 210 having a 1:1 weft ratio according to another embodiment of the present invention. FIG. 7 depicts the forming or paper side plan view of the triple layer fabric. As in FIGS. 4 and 5A-5C, the second set of warp yarns form an exchange warp pair. The difference is that the warp yarns have a different weave pattern.

Figure 8A:
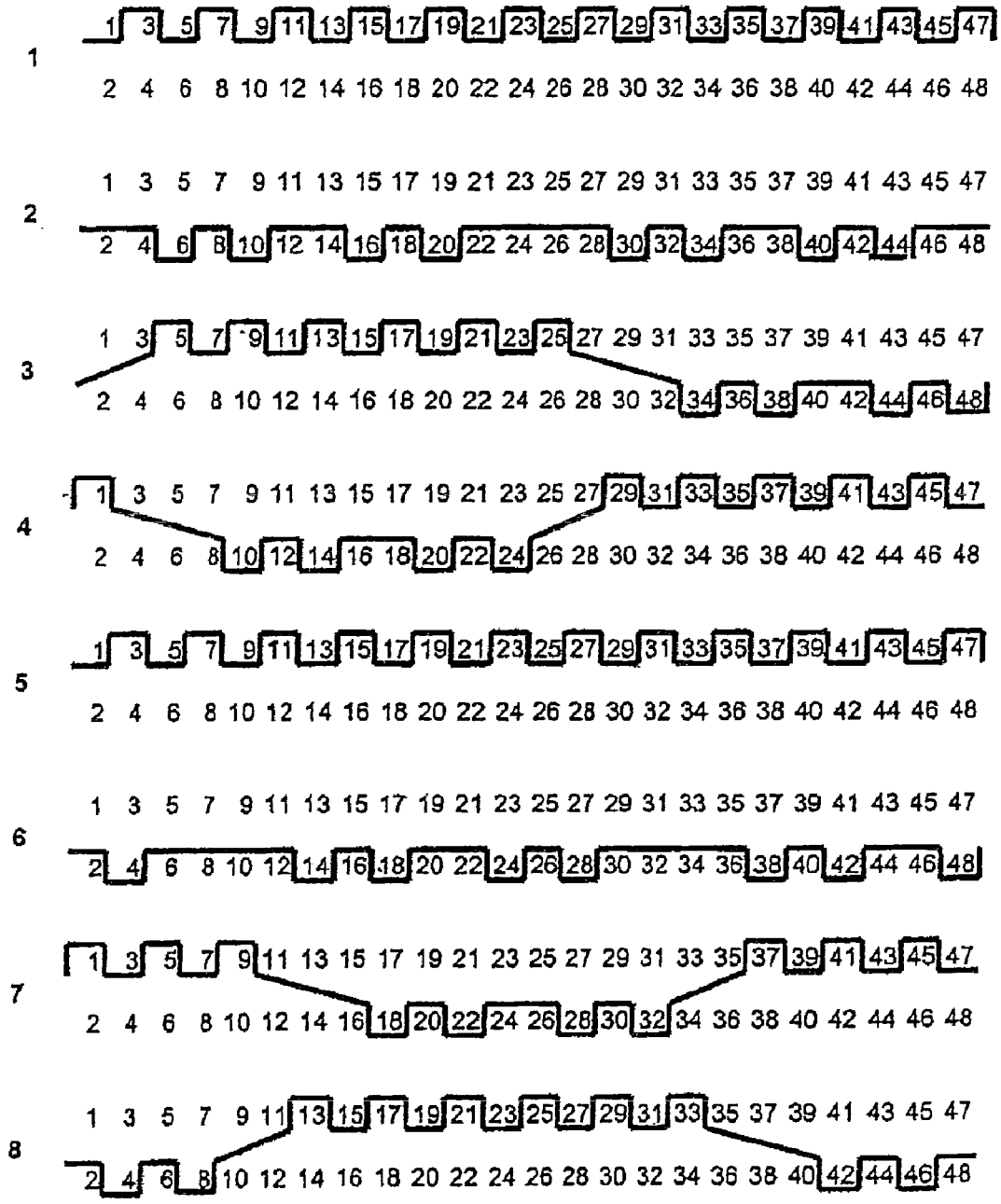
FIGS. 8A-8C show the individual weave pattern for each warp yarn of FIG. 7.
Figure 8B:
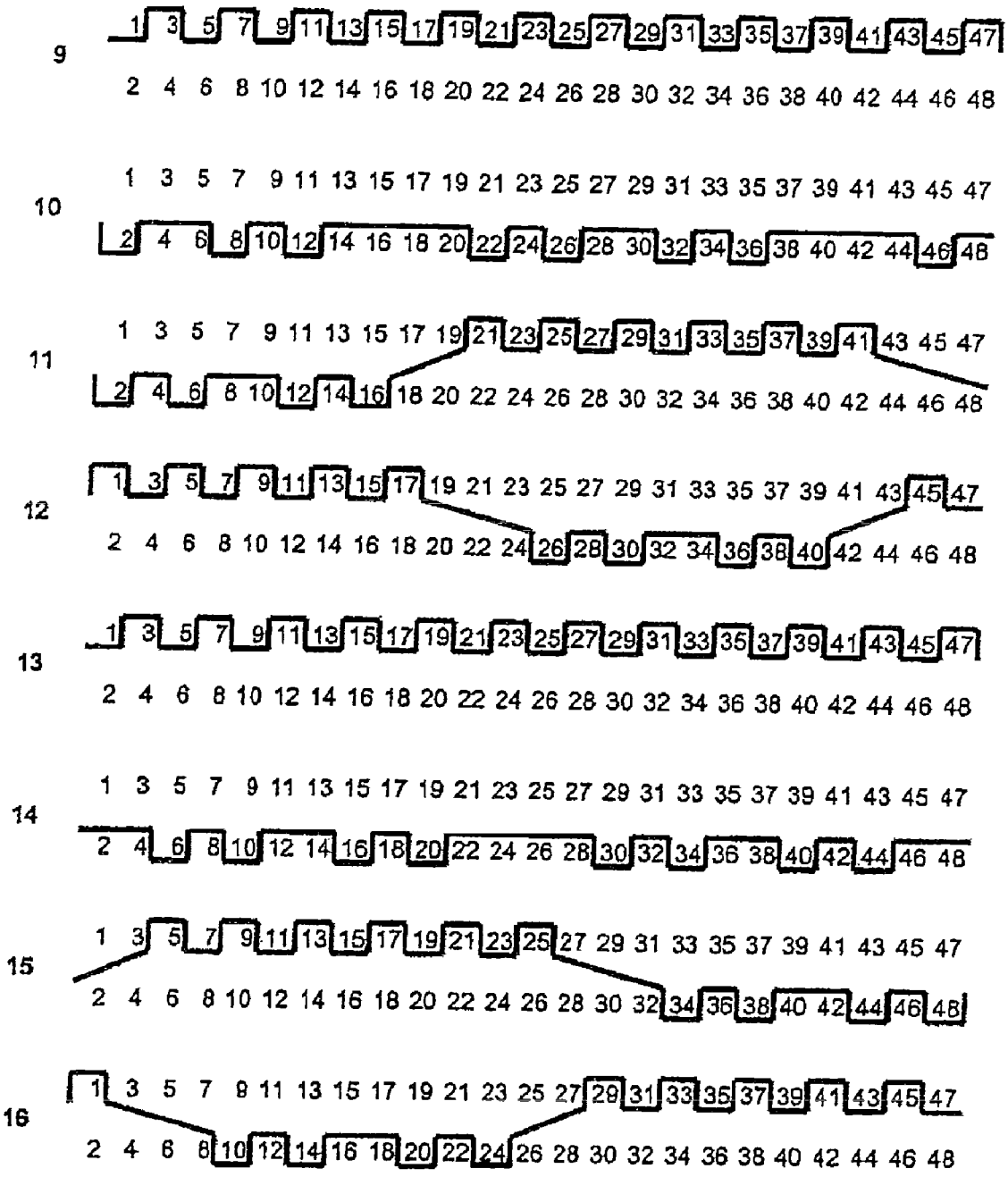
Figure 8C:
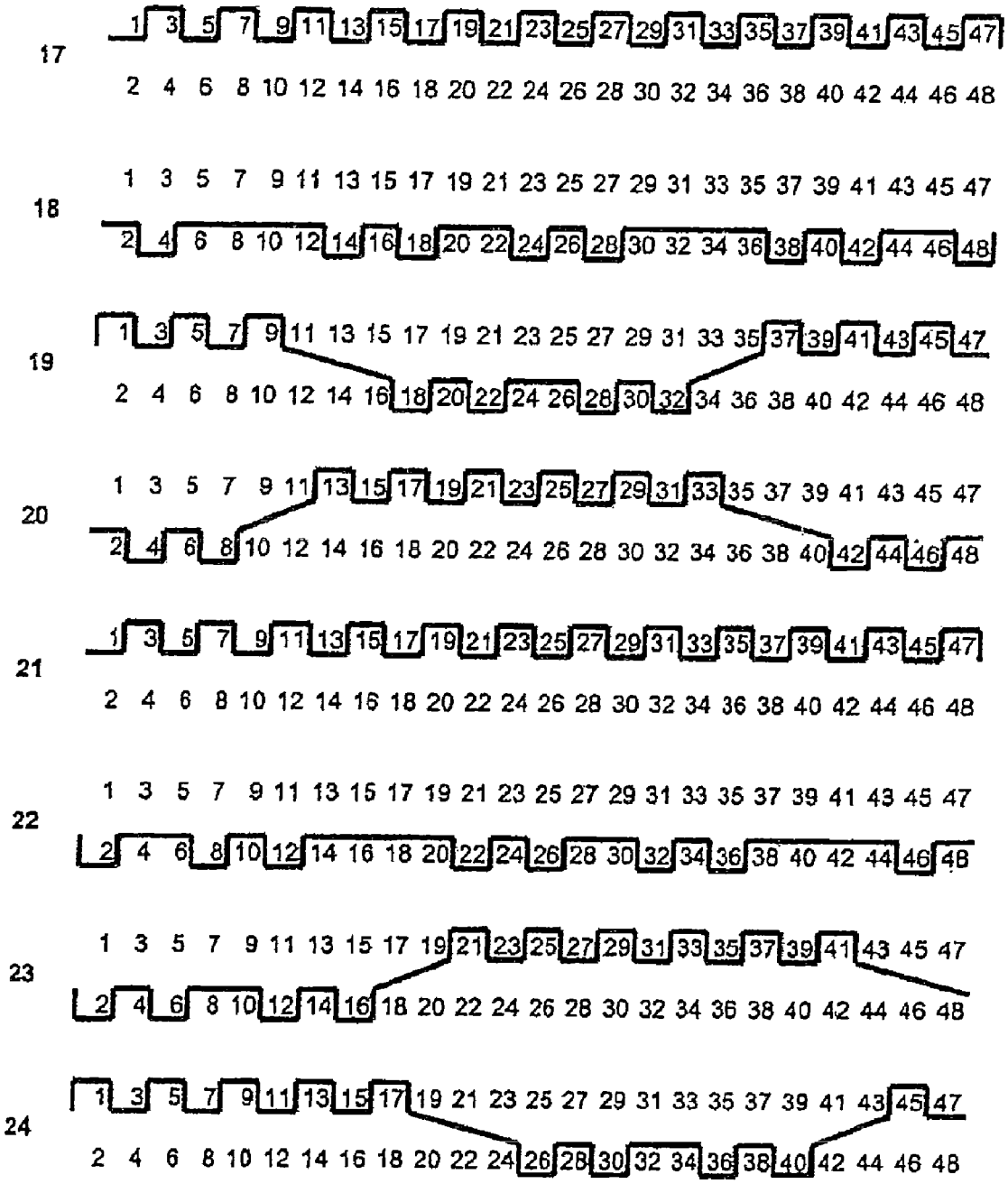

FIGS. 8A-8C depict a cross-sectional view of a triple layer fabric having a 1:1 weft ratio. Twenty-four warp yarns and forty-eight weft yarns are shown with the designations of the boxes of FIG. 7 being the same as for FIG. 4.

A further example of a triple layer fabric according to another embodiment of the present invention can be provided.

The fabric has twenty-four warp yarns and thirty-six weft yarns like those for FIGS. 4 and 7 as described above.

On at least one side of the fabric, knuckles are formed by the weaving of a binder warp yarn with alternating adjacent non-binder warp yarns. This causes the knuckles to alternate back and forth as can be seen by the shaded blocks of FIGS. 4 and 7. This is in contrast to the prior art as illustrate in FIG. 2 where the knuckles do not alternate. This pattern continues as the yarns of the binder warp yarn pair exchange their weaving with the first and second layers of the fabric. In some cases no more than four knuckles are formed in this manner between exchange points. In other patterns of the present invention no more than two knuckles are formed between exchange points.

The invention as it has been described can be fabricated on a three beam loom. Likewise, the triple layer fabric of the present invention can also be fabricated on a four beam loom. Use of four beams could result in similar fabrics, with the addition of at least one of a top only warp, a bottom only warp, a bottom warp that binds at the second weft system, and a top pair that binds with the second weft system.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fabric for papermaking, comprising:

a first side layer including a plurality of first weft yarns and a plurality of first warp yarns;

a second side layer including a plurality of second weft yarns and a plurality of second warp yarns; and at least one binder warp yarn pair including a first binder warp yarn pair having a first binder warp yarn and a second binder warp yarn, said first side layer and said second side layer being bound by said first binder warp yarn pair, said first binder warp yarn and said second binder warp yarn exchanging respectively said first and second side layers to which said first and second binder warp yarns are woven at a plurality of exchange points, a knuckle being formed with said first binder warp yarn and an adjacent said first warp yarn, a subsequent adjacent knuckle only being formed with said first binder warp yarn and an opposite adjacent said first warp yarn.

2. The fabric for papermaking of claim 1, wherein no more than four knuckles are formed between said plurality of exchange points on said first side layer along said binder warp yarn pair.

3. The fabric for papermaking of claim 1, wherein no more than two knuckles are formed between said plurality of exchange points on said first side layer along said binder warp yarn pair.

4. The fabric for papermaking of claim 1, wherein said knuckle is a first knuckle, said subsequent adjacent knuckle being a second knuckle, said second knuckle being a last knuckle prior to a respective one of said plurality of exchange points, after said respective one of said plurality of exchange points said second binder warp yarn forming a third knuckle with said adjacent first warp yarn.

5. The fabric for papermaking of claim 4, wherein said second binder warp yarn forms a fourth knuckle with said opposite adjacent warp yarn.

6. The fabric for papermaking of claim 5, wherein on said first side layer said at least one binder warp yarn pair only has alternating knuckles in a repeating pattern.

7. The fabric for papermaking of claim 1, wherein at least one of said plurality of first weft yarns and said plurality of second weft yarns includes a first yarn having a first diameter, a second yarn having a second diameter, and a third yarn having a third diameter.

8. The fabric for papermaking of claim 7, wherein at least one of said plurality of first warp yarns, said plurality of second warp yarns, and said at least one binder warp yarn pair includes a warp yarn having a diameter different than said first diameter, said second diameter, and said third diameter.

9. The fabric for papermaking of claim 1, wherein said warp yarns and said weft yarns of the fabric include at least one of a monofilament yarn and a twisted pair yarn.

10. The fabric for papermaking of claim 1, wherein the fabric is fabricated using a loom having at least three warp beams.

11. The fabric according to claim 1, wherein said first side layer forms a wear side of the fabric.

12. The fabric according to claim 1, wherein said second side layer forms a paper side of the fabric.

13. The fabric according to claim 12, wherein said second side layer is woven in a plain weave.

14. The fabric according to claim 1, wherein each said pair of binder warp yarns is located between subsequent adjacent said first warp yarns.

15. The fabric according to claim 1, wherein each said pair of binder warp yarns is located between subsequent adjacent said second warp yarns.

16. A fabric for papermaking, comprising:

a first side layer including a plurality of first weft yarns, a plurality of first warp yarns, and an exterior side;

a second side layer including a plurality of second weft yarns, a plurality of second warp yarns, and an exterior side; and at least one binder warp yarn pair including a first binder warp yarn and a second binder warp yarn, said first side layer and said second side layer being bound by said at least one binder warp yarn pair, said first binder warp yarn and said second binder warp yarn exchanging respectively said first and second side layers to which said first and second binder warp yarns are woven at a plurality of exchange points, said binder warp yarn pair being located between two subsequent adjacent said first warp yarns, a knuckle being formed when one of said first binder warp yarn, said second binder warp yarn, and one of said first warp yarns of said two subsequent adjacent first warp yarns passes on said exterior side of said first side layer over only one first weft yarn, and when said first binder warp yarn of said binder warp yarn pair weaves said first side layer, between subsequent adjacent said exchange points: (1) said first binder warp yarn and one of said two subsequent adjacent first warp yarns form a first knuckle with a same said first weft yarn; and (2) said first binder warp yarn and another of said two subsequent adjacent first warp yarns form a subsequent adjacent second knuckle with a same said first weft yarn which is different than said same first weft yarn relative to said first knuckle.

17. The fabric according to claim 16, wherein when said second binder warp yarn of said binder warp yarn pair weaves said first side layer, between subsequent adjacent said exchange points: (1) said second binder warp yarn and one of said two subsequent adjacent first warp yarns form a third knuckle with a same said first weft yarn; and (2) said second binder warp yarn and another of said two subsequent adjacent first warp yarns form a subsequent adjacent fourth knuckle with a same first weft yarn which is different than said same first weft yarn relative to said third knuckle.

* * * * *